United States Patent [19]

Stefanov

[11] 4,158,190

[45] Jun. 12, 1979

[54] WAILING SIREN DETECTING CIRCUIT

[76] Inventor: Boris Stefanov, 1635 Lucile Ave., No. 8, Los Angeles, Calif. 90026

[21] Appl. No.: 848,461

[22] Filed: Nov. 4, 1977

[51] Int. Cl.[2] ..... G08G 1/00

[52] U.S. Cl. ..... 340/34; 340/32; 340/171 R

[58] Field of Search ..... 340/32, 33, 34, 171 R; 325/117, 312, 364, 455

[56] References Cited

U.S. PATENT DOCUMENTS

| | | | |
|---|---|---|---|
| 2,355,607 | 8/1944 | Shepherd | 340/34 |
| 3,399,378 | 8/1968 | Carter et al. | 340/34 |
| 3,568,144 | 3/1971 | Streb | 340/34 |
| 3,626,365 | 12/1971 | Press et al. | 340/34 |
| 3,735,342 | 5/1973 | Helliker et al. | 340/34 |
| 3,859,623 | 1/1975 | Koehler | 340/34 |

*Primary Examiner*—John W. Caldwell, Sr.
*Assistant Examiner*—James J. Groody
*Attorney, Agent, or Firm*—Ralph B. Pastoriza

[57] ABSTRACT

The detecting circuit is used on cars to indicate the presence of emergency vehicles utilizing wailing sirens the instant invention residing in the unique circuitry itself to result in an extremely inexpensive electronics package for carrying out the desired function. Essentially, the circuit utilizes a band pass filter having a voltage tunable center frequency. Dominant frequencies in a sound spectrum received through the band pass filter are converted to voltages by means of a frequency to voltage converter and fed back to the band pass filter to shift the center frequency of the filter thereby tracking the dominant frequency signal. When the dominant frequency results from a wailing siren, the fed back voltage from the frequency to voltage converter constitutes a slowly continuously varying AC signal corresponding to the pitch variation of the siren. This signal is detected by a low pass filter and differentiating circuit to operate a flasher to indicate the presence of the siren. When the dominant frequency results from noise or steady state sounds or the like resulting in a random shifting of the center frequency of the band pass filter, further filter and integrating means responsive to such random signals generate an inhibiting signal preventing spurious operation of the flasher.

3 Claims, 8 Drawing Figures

WAILING SIREN DETECTING CIRCUIT

This invention relates to emergency vehicle warning devices and more particularly to a unique electronic circuit for detecting a wailing siren.

BACKGROUND OF THE INVENTION

Emergency vehicle warning devices for use in automobiles to detect the presence of an emergency vehicle such as an ambulance or fire engine are well known in the art and numerous patents have issued covering various systems. In spite of the vast amount of prior art in this field, there has been little if any use of such devices by the average automobile owner. The primary reason for this lack of enthusiasm comes down to the cost of the item to the individual. In order to avoid false triggering of the device by outside sounds other than an emergency vehicle sound such as a siren, the circuits involved must discriminate carefully and as a result such circuits as have been available have been fairly expensive.

In order that a vehicle warning device be readily acceptable, it is essential that the cost be kept to an absolute minimum so that the average owner can readily afford to purchase the device and use it in his car. However, attempts to skimp on electronic circuitry design in order to produce a cheap or inexpensive package have always heretofore resulted in an inferior product which is susceptible to false triggering.

BRIEF DESCRIPTION OF THE PRESENT INVENTION

From the foregoing considerations, it would seem that providing an emergency vehicle detecting device not subject to spurious operation and yet of sufficiently low cost to encourage purchase are essentially mutually exclusive and in actuality such has been the case up to the time of this present invention.

Essentially, the present invention provides an electronic circuitry for detecting a wailing siren which is substantially immune from false triggerings or triggering by noise signals other than that of a wailing siren and yet can be manufactured at a fraction of the cost of presently available units.

Briefly, the basic components of the detector include a microphone, a preamplifier, a band pass filter connected to the pre-amplifier, center frequency tuning means connected to the band pass filter and responsive to the dominant frequency in the signals from the pre-amplifier for shifting the center frequency of the filter to track such dominant frequency, further means responsive only to a continuously slowly varying of the center frequency at a rate corresponding to the pitch variation of a wailing siren to generate an output signal, and appropriate indicating means responsive to the output signal to indicate the presence of the wailing siren.

Also included in the preferred embodiment is an inhibit signal generating means responsive to erratically rapidly varying random center frequency tracking resulting from dominant noise frequencies for inhibiting operation of the indicating means so that the indicating means will only be responsive to a wailing siren.

A unique use of field effect transistors in combination with current-mirror (Norton input) quad type operational amplifiers enables the realization of a very cost-effective and simple solution to the detection of a wailing siren.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
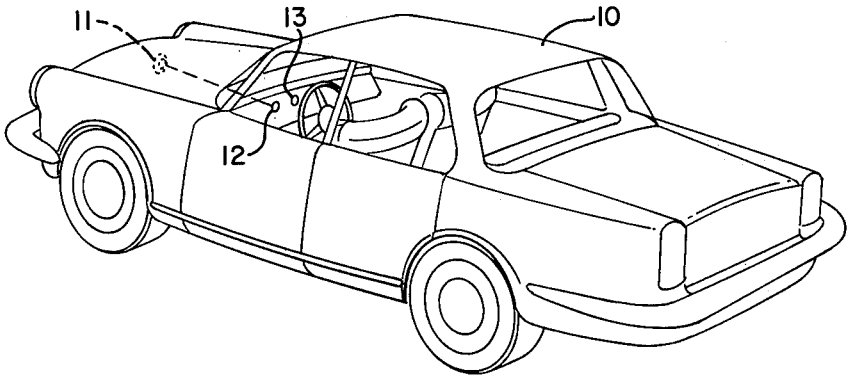
FIG. 1 is a perspective view of a car incorporating the wailing siren detecting circuit of this invention.

Referring first to FIG. 1, there is shown a car 10 equipped with a microphone 11 mounted on the car top or to the front portion of the car hood as shown by the dotted lines. A small light emitting diode 12 and flasher 13 are located on the dashboard of the car 10. Flashing of the flasher bulb 13 will indicate to a driver the presence of a wailing siren and thus warn the driver that an emergency vehicle is in the area.

Figure 2:
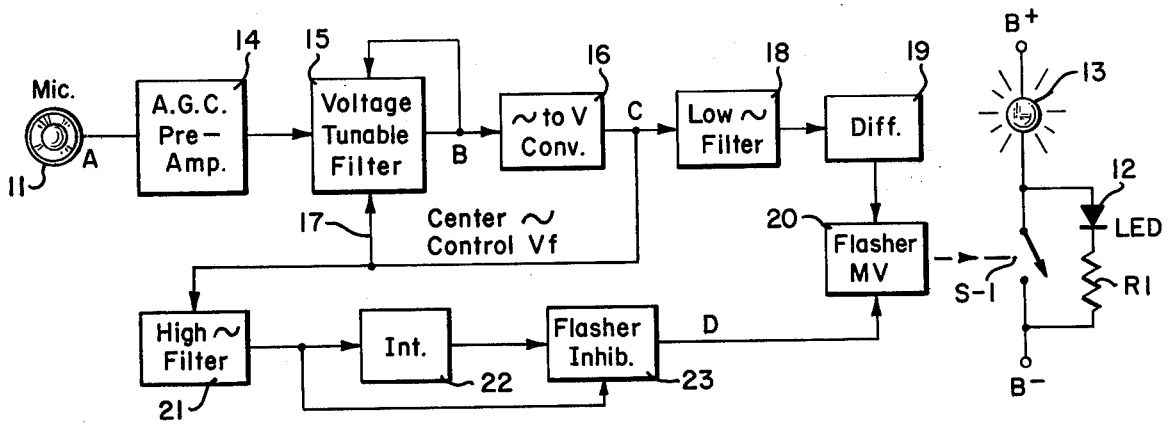
FIG. 2 is a basic block diagram of the electronic components making up the detecting circuit utilized in the car of FIG. 1.

Referring now to FIG. 2, there is shown a block diagram of the basic circuit components for detecting the wailing siren. The microphone 11, light emitting diode 12 and flasher bulb 13 are indicated by the same numerals in FIG. 2.

Referring to the upper left portion of FIG. 2, the microphone 11 will pick up all outside sounds transducing these sounds into electrical signals of various frequencies. A pre-amplifier 14 is connected to the microphone as shown and includes automatic gain control means to provide improved linearity at high signal input levels. Because of this automatic gain control feature, the output signal from the pre-amplifier is of a constant voltage amplitude but no clipping is involved.

A high Q voltage tunable band pass filter 15 is connected to the output of the pre-amplifier as shown. As will become clearer as the description proceeds, the voltage tunable filter 15 is responsive to a control voltage to shift its center frequency so that the frequency band pass defined by the filter can shift up and down the sound spectrum.

The output of the voltage tunable filter 15 passes to a frequency to voltage converter 16. A feedback means passes from the frequency to voltage converter 16 to the voltage tunable filter as indicated by the lead 17 in FIG. 2.

A voltage is developed by the frequency to voltage converter 15 which in turn through the feedback will shift the center frequency of the band pass filter as a function of the voltage, thereby resulting in a tracking of the dominant frequency by the band pass filter 15.

The control voltage fed back from the frequency to voltage converter is indicated as Vf. This voltage signal passes into a low frequency filter 18 and thence to a full wave rectifier and differentiating circuit indicated at 19.

The full wave rectifier and differentiating circuit 19 provides an output signal only in response to a continuously slowly varying voltage signal corresponding to the pitch variation of a wailing siren. If there is essentially no rate of change of the signal from the low frequency filter 18 to the full wave rectifier and differentiating circuit 19, there will not be generated any output signal since differentiation of a constant level is essentially zero.

A flasher circuit energizing means indicated at 20 is connected to the differentiating circuit 19 for receiving any output signal appearing thereon and energizing the flasher circuit made of the flashing bulb 13 and light emitting diode 12 shown to the right of FIG. 2. In this respect, the flasher energizing circuit may constitute a multi-vibrator which will periodically open and close a switch S-1 in series with the flashing bulb 13, this series circuit being connected between positive voltage supply and negative voltage supply designated B+ and B−.

The particular flasher circuit includes the LED 12 and a series connected resistance R1, this series circuit shunting the switch S-1. The current passed through the resistance R1 and the light emitting diode to energize the same is not sufficient to energize the flasher bulb 13. The purpose for light emitting diode is simply to indicate that power is on and that the filament of the flasher bulb 13 is in operating condition.

To provide further protection against spurious operation of the flasher, the circuit of this invention also includes an inhibiting means which will block operation of the flasher energizing circuit 20 in the event the frequencies tracked by the voltage tunable filter 15 and frequency to voltage converter 16 combination is not the result of a wailing siren.

Towards the foregoing end, there is provided as shown in the lower left portion of FIG. 2 a high pass filter and amplifier means 21 connected to receive the output from the frequency to voltage converter 16 and to pass only erratically rapidly varying high frequency noise signals developed as a result of tracking dominant noise frequencies by the voltage tunable filter 15. A full wave rectifier and integrating circuit 22 in turn connects to the output of the high pass filter and amplifier means 21 to provide an inhibit signal only when the voltage signal is erratically varying as a result of tracking of said dominant noise frequencies.

The flasher circuit energizing means 20 is arranged to be inhibited by a flasher inhibiting means 23 connected between the flasher energizing circuit 20 and output of the integrator 22 in response to the generation of the inhibit signal so that the flasher will only be energized in response to a wailing siren.

Figure 3:
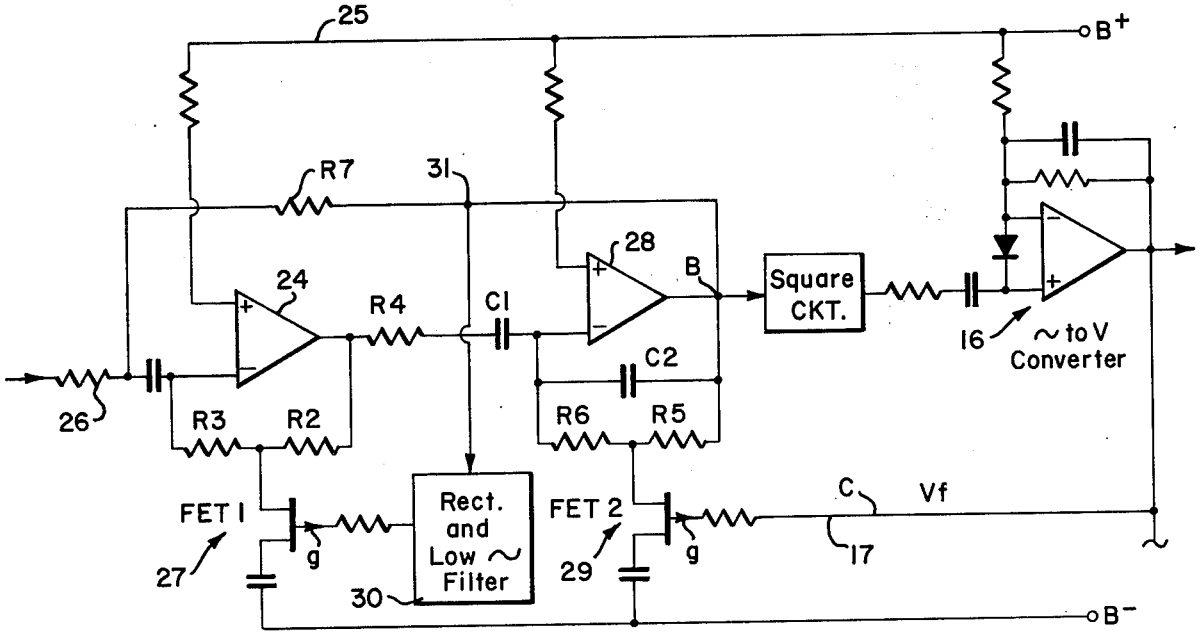
FIG. 3 is a more detailed schematic diagram of a portion of the circuit of FIG. 2.

Referring now to FIG. 3, further details of the high Q voltage tunable band pass filter and feedback circuit from the frequency to voltage converter 16 will be described.

Referring to the left portion of FIG. 3, the circuit includes a first operational amplifier 24 receiving positive power supply voltage B+ on its positive input by way of the power line 25 and having its negative input coupled to receive the output signal from the pre-amplifier means on lead 26.

A first negative feedback resistance T network designated generally by the numeral 27 includes first and second resistances R2 and R3 in the arms of the T connected between the output and negative input of the operational amplifier 24. The first resistance R2 is much greater than the second resistance R3. A first field effect transistor FET1 in turn is provided in the leg of the T defining a resistance which varies as a function of voltage applied to its gate g such that increased voltage increases the amount of negative feedback for the operational amplifier 24.

As shown in the center portion of FIG. 3 there is provided a second operational amplifier 28 having its positive input connected to the positive power supply voltage on line 25 and coupled to the output of the operational amplifier 24 on its negative lead by a series connected resistance and capacitor R4 and C1 defining essentially a lead network. A second T network designated generally by the numeral 29 includes third and fourth resistances R5 and R6 in the arms connected in series between the output and negative input of this second operational amplfier 28 as shown. In addition, a capacitor C2 shunts the third and fourth resistances. A second field effect transistor FET2 is disposed in the leg of this second T network defining a resistance which varies as a function of voltage applied to its gate g. This second T network essentially constitutes a lag network.

The frequency to voltage converter 16 is shown on the extreme right of FIG. 3, the voltage output from this converter being applied to the gate g of the second field effect transistor FET2 as shown. This feedback lead is indicated by the numeral 17 corresponding to the connection illustrated in FIG. 2.

A positive feedback resistance R7 is connected between the output of the second operational amplifier 28 and the output of the pre-amplifier on lead 26.

The circuit is completed by the provision of a rectifier and low frequency filter designated by the block 30 connected between the junction lead at 31 of the positive feedback resistance R7 and the output of the second operational amplifier 28, and the gate g of the first field effect transistor FET1.

With the foregoing arrangement, the lead network and lag network described define the center frequency of the band pass filter. In the absence of a signal input on lead 26 into the first operational amplifier 24, the voltage tunable band pass filter acts as a sinusoidal oscillator (essentially Q=infinity). When a signal input is provided on the lead 26 resulting in the output of the second operational amplifier 28 reaching a predetermined fraction of the positive power supply voltage, the first variable resistance feedback network 27 compensates for the positive feedback across resistance R7, the center frequency being varied by the voltage control on the gate g of the second field effect transistor FET2 in the second T network for the second operational amplifier 28.

It will thus be appreciated from the foregoing that the generation of a continuously slowly varying voltage signal from the frequency to voltage converter 16 corresponding to the pitch variation of a wailing siren will vary the resistance of FET2 to shift the center frequency of the band pass filter in a like slowly varying manner to exactly track this signal. The feedback arrangement described thus eliminates all noise from the control voltage Vf at the output of the frequency to voltage converter. As described with respect to FIG. 2, it is this continuously slowly varying voltage signal that is then passed by the low frequency filter block 18 to the full wave rectifier and differentiating circuit 19 to provide an appropriate output signal for the flasher energizing circuit 20 thereby energizing the flasher 13.

It will also be appreciated that should the band pass filter be tracking a dominant frequency other than a continuously slowly varying frequency corresponding to the pitch variation of a wailing siren, such tracking will be random or erratic and thus the control voltage Vf will correspondingly be random and erratic. This latter signal characteristic is detected in the high frequency filter 21 and integrator 22 of FIG. 2 to provide the desired inhibit signal and inhibit the flasher indicated by the block 23.

Referring now to the various wave forms of FIGS. 4 through 8, the foregoing described operation will become clearer.

Figure 4:
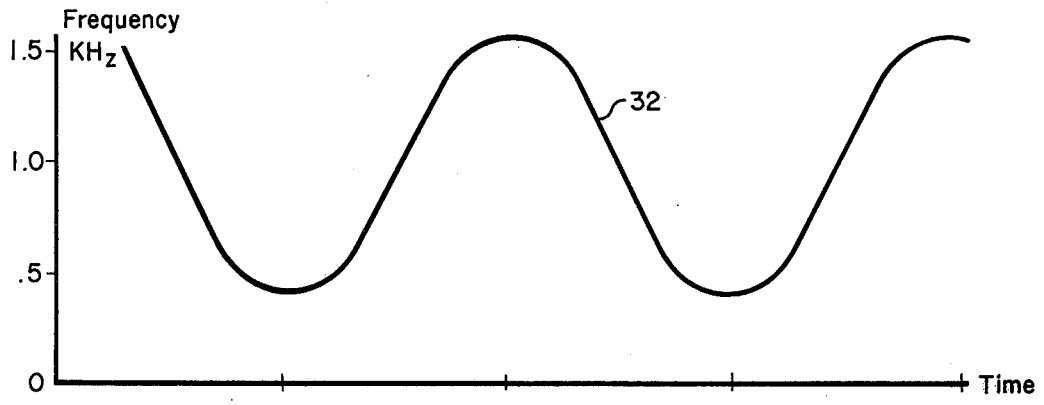
FIG. 4 is a frequency plot of a wailing siren.

Referring first to FIG. 4, there is depicted at 32 the variation in frequency of a typical wailing siren as a function of time. As indicated, the plot follows essentially a sine wave, the lowest pitch corresponding to perhaps 400 Hz and the highest pitch or frequency approaching 1500 Hz or 1.5 KHz.

Figure 5:
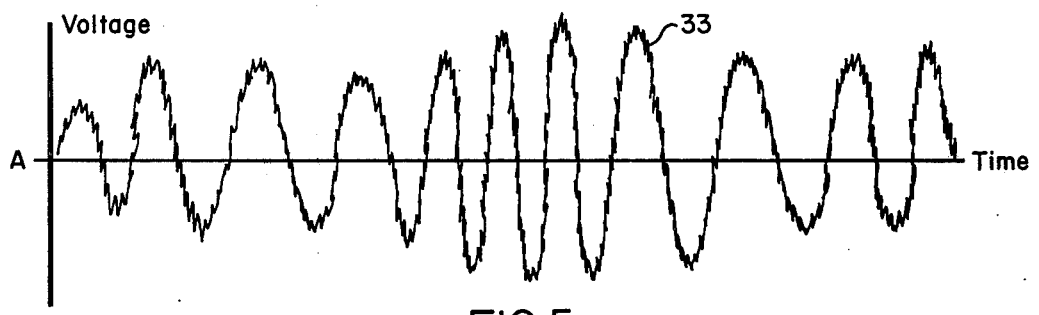
FIGS. 5, 6, 7 and 8 illustrate wave forms designated by the letters A, B, C and D respectively occurring at correspondingly lettered points in the circuit of FIGS. 2 and 3, all useful in explaining the operation of the invention.

FIG. 5 depicts at 33 the output of the microphone at the lettered point A in the block diagram of FIG. 2 wherein a wailing siren has resulted in the generation of a dominant frequency. The wave form is somewhat erratic, various noise frequency components being shown superimposed thereon. Further, the amplitude or loudness may vary in a random manner as shown in FIG. 5.

Figure 6:
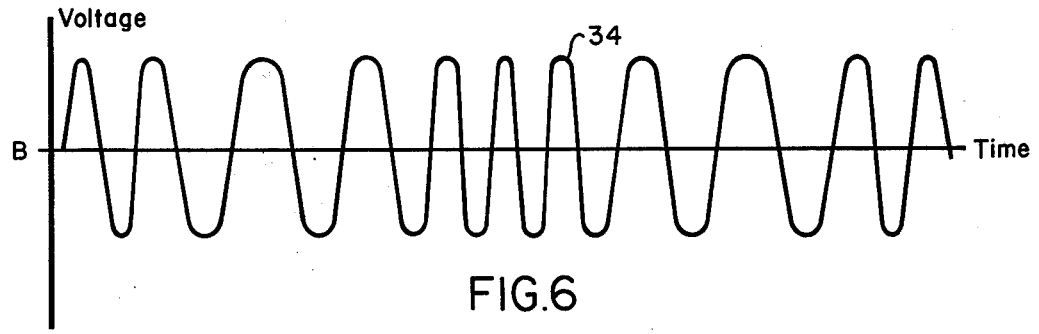

FIG. 6 shows a signal 34 corresponding to the signal 33 after passing through the pre-amplifier with automatic gain control and the band pass voltage tunable filter, this signal appearing at the point B in the block diagram of FIG. 2. It will be noted that the signal is of constant amplitude as a consequence of the automatic gain control in the pre-amplifier. Further, it will be noted that all noise components have been removed from this signal by action of the voltage tunable filter 15.

When the signal 34 passes to the frequency to voltage converter circuit 16 described in the block diagram there will be generated the centering control voltage Vf shown at 35 which constitutes a continuously slowly varying voltage signal causing the tracking of the varying frequency signal 34 by the filter through the feedback 17 as described.

Figure 7:
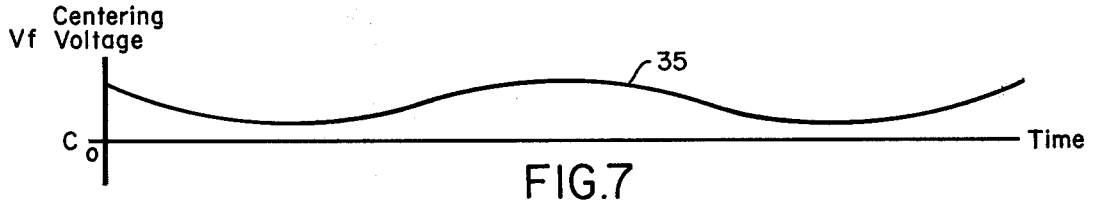
Figure 8:
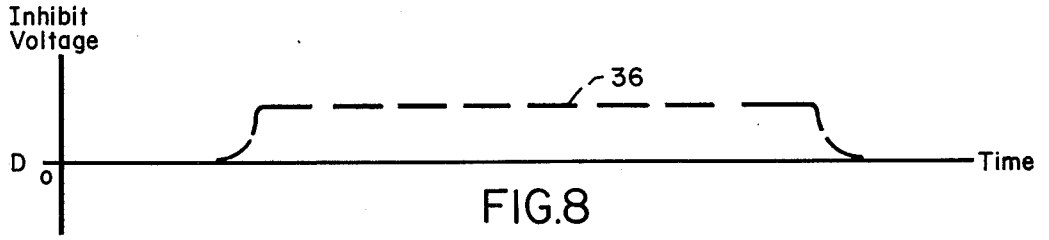

The presence of the signal 35 of the form shown in FIG. 7 can only result from the wailing siren when the frequency of the wailing siren is the dominant frequency passed through the band pass filter 15.

In the absence of a wailing siren constituting the dominant frequency, there will be other noise frequencies which will dominate and cause the band pass filter to track in a random and erratic manner. The center frequency control voltage Vf will thus similarly randomly vary and thereby result in the generation of an inhibit voltage signal indicated in FIG. 8 at 36 all as described in conjunction with the block diagram of FIG. 2.

In summary, if the frequency is a siren wail, the frequency to voltage converter output is "noise free" and has a low frequency component used to trigger the flasher. Any "noise" due to the latching on to another frequency is amplified and processed to provide an inhibit signal and inhibit the flasher energizing circuit.

From all of the foregoing, it will thus be evident that the present invention has provided a wailing siren detecting circuit substantially free of error operation and yet utilizing components in such a manner that the manufacture thereof can be undertaken for relatively little expense, thereby providing for the first time a marketable product.

I claim:

1. A wailing siren detecting circuit including, in combination:

(a) a microphone for mounting on a car in a position to detect outside sounds;

(b) a pre-amplifier connected to said microphone including automatic gain control means to provide improved linearity at high signal input levels;

(c) a high Q voltage tunable band pass filter connected to the output of said pre-amplifier;

(d) a frequency to voltage converter connected to the output of said high Q voltage tunable band pass filter;

(e) a feedback means from the output of said frequency to voltage converter to said high Q voltage tunable band pass filter to shift the center frequency of said band pass filter as a function of the voltage output of said frequency to voltage converter whereby tracking of a dominant frequency by said band pass filter is achieved;

(f) a low frequency band pass filter receiving said voltage from said frequency to voltage converter for passing only low frequency signals;

(g) a full wave rectifier and differentiating circuit connected to the output of said low band pass filter for providing an output signal only in response to a continuously slowly varying voltage signal corresponding to the pitch variation of a wailing siren;

(h) an indicating means for mounting in said car;

(i) energizing means connected to said indicating means and to the output of said full wave rectifier and differentiating circuit for energizing said indicating means in response to the presence of said output signal from said full wave rectifier and differentiating circuit;

(j) high pass filter and amplifier means connected to the output of said frequency to voltage converter for passing only erratically rapidly varying high frequency noise signals developed as a result of tracking dominant noise frequencies;

(k) full wave rectifier and integrating circuit means connected to the output of said high pass filter and amplifier means providing an inhibit signal only when said voltage signal is erratically varying as a result of tracking said dominant noise frequencies; and (l) inhibiting means connected between said indicating means and said full wave rectifier and integrating means for inhibiting operation of said indicating means in response to receiving said inhibit signal whereby said indicating means is only energized in response to a wailing siren.

2. A circuit according to claim 1, in which said high Q voltage tunable band pass filter and said feedback means include: a first operational amplifier receiving positive power supply voltage on its positive input and having its negative input coupled to receive said output signal from said pre-amplifier means; a first negative feedback resistance T network including first and second resistances in the arms connected between the output and negative input of said first operational amplifier and a first field effect transistor in the leg defining a resistance which varies as a function of voltage applied to its gate such that increased voltage increases the amount of negative feedback; a second operational amplifier having its positive input connected to positive power supply voltage; a series connected resistance and capacitor connecting the output of said first operational amplifier to the negative input of said second operational amplifier to define a lead network; a lag network connected between the outputs of said second operational amplifier and its negative input and including a second T network including third and fourth resistances in the arms connected in series between the output and negative input of said second operational amplifier, a capacitor shunting said third and fourth resistances, and a second field effect transistor in the leg of said second T network defining a resistance which varies as a function of voltage applied to its gate, said voltage output from said frequency to voltage converter being applied to said gate of said second field effect transistor, said lead network and lag network defining the center frequency of said band pass filter; a positive feedback resistance connected between the output of said second operational amplifier and said output of said pre-amplifier; and, a rectifier and low frequency filter connected between the junction of said positive feedback resistance and said output of said second operational amplifier, and the gate of said first effect transistor, whereby in the absence of a signal input into said first operational amplifier from said pre-amplifier means, said voltage tunable band pass filter acts as a sinusoidal oscillator and whereby when a signal input is provided resulting in the output of said second operational amplifier reaching a predetermined fraction of said positive power supply voltage, said first variable resistance feedback network compensates for the positive feedback, the center frequency being varied by the voltage control on the gate of said second field effect transistor in the second T network for said second operational amplifier.

3. A circuit according to claim 2, in which said indicating means includes a flasher bulb and switch connected in series between positive and negative voltage terminals of said power supply; and a light emitting diode and series connected resistance shunting said switch, said light emitting diode being continuously energized through said resistance to thereby indicate that power is available and that the filament of said flasher bulb is intact, the current passing through said resistance and light emitting diode not being sufficient to illuminate said flasher bulb.

* * * * *